United States Patent [19]

Greve et al.

[11] 4,020,751

[45] May 3, 1977

[54] APPARATUS FOR MAKING COMPOSITE FILTER PLUGS

[75] Inventors: Heinz Greve; Peter Grumer, both of Hamburg, Germany

[73] Assignee: Hauni-Werke Korber & Co., KG, Hamburg, Germany

[22] Filed: Oct. 15, 1975

[21] Appl. No.: 622,757

[30] Foreign Application Priority Data

Nov. 7, 1974 Germany ..... 2452749

[52] U.S. Cl. ..... 93/77 FT

[51] Int. Cl.[2] ..... A24C 5/50

[58] Field of Search ..... 93/1 C, 77 FT; 131/267, 131/264, 261 R; 118/66, 67, 101

[56] References Cited

UNITED STATES PATENTS

| | | | |
|---|---|---|---|
| 3,131,612 | 5/1964 | Rowlands | 93/1 C |
| 3,371,000 | 2/1968 | Davenport et al. | 93/1 C |
| 3,762,281 | 10/1973 | Burrus et al. | 93/1 C |
| 3,828,658 | 8/1974 | Brodbeck et al. | 93/1 C |

FOREIGN PATENTS OR APPLICATIONS

| | | | |
|---|---|---|---|
| 1,378,170 | 12/1974 | United Kingdom | 93/77 FT |

*Primary Examiner*—James F. Coan

*Attorney, Agent, or Firm*—Peter K. Kontler; John Kurucz

[57] ABSTRACT

Apparatus for making composite filter plugs for cigarettes or the like has a garniture which transports a web of cigarette paper or the like past a transfer conveyor which deposits on the web groups of aligned filter rod sections of two or more different types so that the sections are disposed end-to-end and form a continuous filler. Those portions of the web which are contacted by the sections are coated with a wet adhesive or a heat-activatable adhesive to insure that the sections cannot be shifted relative to the web, and the adhesive is heated or cooled in the region of the transfer conveyor to promote rapid setting. One marginal portion of the web is coated with wet adhesive or heat-activatable adhesive upstream or downstream of the transfer conveyor, and the web thereupon passes through a wrapping mechanism which drapes the web around the filler so that the one marginal portion adheres to the other marginal portion and the web constitutes the tubular wrapper of a filter rod which is severed at regular intervals to yield filter plugs each of which contains at least a portion of each type of section. The adhesive which is applied by the second paster is heated or cooled downstream of the wrapping mechanism.

11 Claims, 5 Drawing Figures

APPARATUS FOR MAKING COMPOSITE FILTER PLUGS

BACKGROUND OF THE INVENTION

The present invention relates to improvements in apparatus for making composite filter plugs which can be used in the manufacture of filter-tipped cigarettes, cigars or cigarillos.

A composite filter plug comprises two or more fillers which normally consist of different types of filter material and a tubular wrapper which confines the fillers and is open at both ends. As a rule, composite filter plugs are produced in apparatus wherein a continuous rod-like filler consisting of two or more types of alternating filter rod sections is conveyed axially through a wrapping mechanism which drapes the continuous filler into a web of cigarette paper, imitation cork or other suitable wrapping material. The resulting rod is thereupon severed by a suitable cutoff to yield a file a discrete filter plugs each of which comprises at least two rod-like sections consisting of different filter materials, e.g., a first section consisting exclusively of fibrous filamentary filter material and a second section consisting of crepe paper or filamentary filter material interspersed with particles of charcoal.

It is important to insure that the sections which form the continuous filler be disposed end-to-end, i.e., the neighboring sections should abut against each other in order to insure that each of a series of filter plugs will contain two or more different filter rod sections of predetermined length. Since the cutoff invariably severs the rod at regular intervals, the operation which precede the severing of the rod must or should be carried out in such a way that, in the case of relatively simple plugs having two rod-like filter sections of identical length and a tubular wrapper therearound, each and every filter plug of a series will contain two sections each having a length equal to half the length of the plug.

Presently known apparatus cannot produce composite filter plugs with a requisite degree of reproducibility for a variety of reasons. For example, if the speed at which the web travels through the wrapping mechanism deviates only slightly from the speed at which filter rod sections are added to the trailing end of the composite filler, at least some of the sections are caused or allowed to slide with respect to the web. This results in the formation of gaps between neighboring sections. Also, at least some slippage of the web relative to the sections of the composite filler takes place while the web is draped around the filler, primarily because friction between the web and the parts of the wrapping mechanism is different from friction between the sections and the web and/or wrapping mechanism. Still further, the filter rod sections are likely to be displaced by currents of air, especially when the web is transported at a relatively high speed.

SUMMARY OF THE INVENTION

An object of the invention is to provide an apparatus which is capable of making composite filter plugs without any or with negligible shifting of filter rod sections relative to the wrapping material so that all filter plugs are identical in each and every respect.

Another object of the invention is to provide the apparatus with novel and improved means for applying and influencing adhesive which is used to convert a web of wrapping material into the tubular wrapper of a composite filter rod and to prevent undesirable shifting of filter rod sections with respect to each other.

A further object of the invention is to provide the apparatus with pasters which can be installed in spaces that are readily available and accessible downstream and/or upstream of the wrapping mechanism.

An additional object of the invention is to provide an apparatus which can utilize one or more types of adhesive.

The invention is embodied in an apparatus for making composite filter plugs wherein a tubular wrapper surrounds several types of rod-like filter material. The apparatus comprises a garniture of analagous means for advancing a continuous web of cigarette paper, imitation cork of othersuitable flexible wrapping material lengthwise along a predetermined path wherein one side of the web remains exposed, a first paster having means (e.g., two nozzles) for applying one or more strips or films of adhesive to an intermediate portion of the one side of the running web in a first portion of the path, a transfer conveyor or analagous means for transferring filter rod sections of several types onto the one side of the web in a second portion of the path (downstream of the first portion) so that the sections abut against each other end-to-end and adhere to the intermediate portion of the one side of the web to form an elongated filler, first sealer means for promoting the setting of adhesive in the region of the second portion of the path so as to reduce the likelihood of shifting of filter rod sections of the filler relative to the web, a second paster having means (e.g., a single nozzle) for applying adhesive to one marginal porton (preferably at the one side) of the web, means for draping the web around the filler so that the one marginal portion contacts and is bonded to the other marginal portion of the web whereby the thus draped web constitutes the tubular wrapper of the resulting filter rod which latter further includes the filler, second sealer means for promoting the setting of adhesive between the two marginal portions of the tubular wrapper, and a cutoff of analagous means for subdividing the rod into a file of discrete filter plugs each of which contains at least a portion of a section of each of the several types.

The adhesive which is applied by the first and/or second paster may be wet (cold) adhesive which sets in response to heating or a so-called hotmelt which is activated by heat and sets in response to cooling. The exact nature of the first and/or second sealer means depends on the type of adhesive which is dispensed by the respective paster, i.e., the sealer means may include a device or cooling the respective portion of the web.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
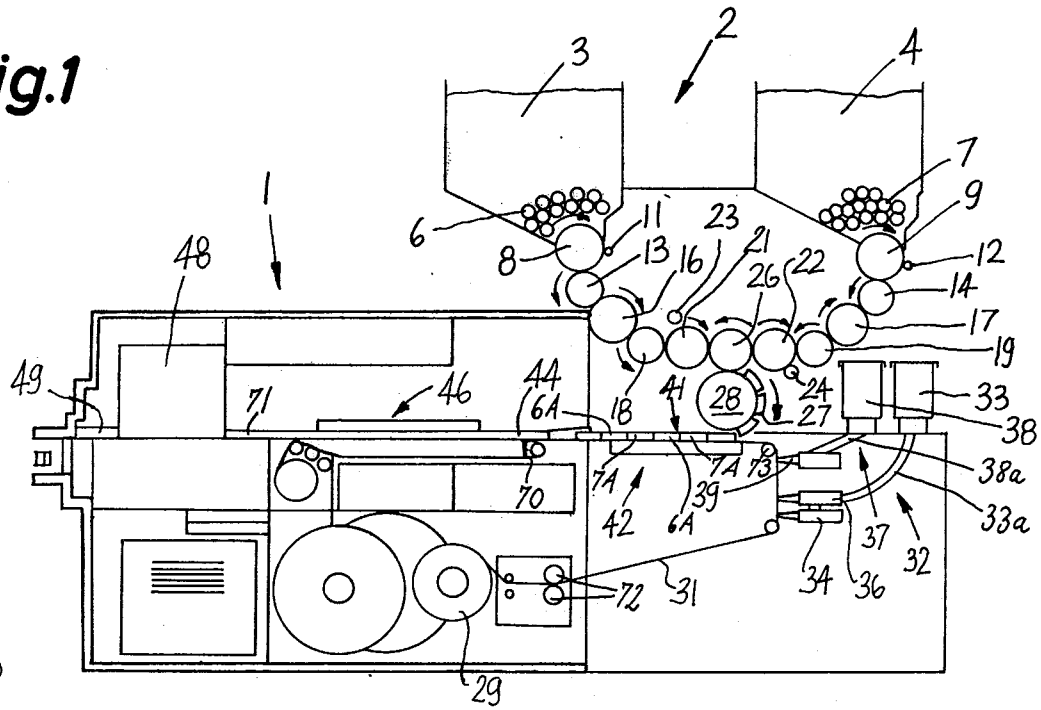
FIG. 1 is a schematic elevational view of a filter plug making apparatus wherein the adhesive applying means embody one form of the invention.

The apparatus 1 of FIG. 1 includes an assembling unit 2 which comprises a rotary drum-shaped assembly conveyor 26, two discrete magazines or hoppers 3,4 and two sets of conveyors which respectively transport and manipulate filter rod sections between the magazines 3,4 and the assembly conveyor 26. The magazine 3 contains a supply of filter rod sections 6 of a first type, and the magazine 4 contains a supply of filter rod sections 7 of a second type. Each of the sections 6,7 is assumed to be long enough to yield eight sections of unit length. The conveyor 26 and the conveyors of both sets transport of filter rod sections sideways.

The conveyors of the first (left-hand) set comprise a rotary drum-shaped withdrawing conveyor 8 which extends into the outlet of the magazine 3 and has peripheral receiving means or flutes (not specifically shown) which transport discrete sections 6 sideways past a rotary disk-shaped knife 11. The latter severs successive sections 6 midway between their ends so that each such section yields two shorter sections of four times unit length. The conveyor 8 delivers pairs of shorter sections to a staggering conveyor 13 having two rollers or wheels which rotate at different speeds and/or transport the respective shorter sections through different distances so that the originally aligned shorter sections of each pair are shifted with respect to each other, as considered in the circumferential direction of the conveyor 13. The latter delivers discrete shorter sections into successive flutes of a rotary drum-shaped shuffling conveyor 16 cooperating with one or two stationary cams which shift selected shorter sections (or all of the shorter sections) axially of the conveyor 16 so that such sections form a single row wherein each preceding section is in exact register with the next-following section. The conveyor 16 delivers successive shorter sections of the single row into successive flutes of a rotary drum-shaped intermediate conveyor 18. The peripheral speed of the conveyor 18 preferably exceeds that of the conveyor 16 and the distance between its flutes exceeds the distance between the flutes of the conveyor 16 so that the conveyor 18 transports a row of shorter sections having a mutual spacing exceeding that of the row in the flutes of the conveyor 16. The conveyor 18 delivers successive shorter sections into the oncoming flutes of a rotary drum-shaped severing conveyor 21 which cooperates with a rotary disk-shaped knife 23 to subdivide each shorter section into a pair of coaxial sections 6A of double unit length. The sections 6A of each pair are thereupon moving axially and away from each other (i.e., at right angles to the plane of FIG. 1) so as to define a gap having a width equal to or exceeding the length of a section 7A. The thus separated pairs of sections 6A are transferred into oncoming flutes of the assembly conveyor 26.

The second set of conveyors comprises conveyors 9,14,17,19,22 and knives 12,24 which respectively correspond to conveyors 8,13,16,18,21 and knives 11,23 and serve to manipulate filter rod sections 7. The severing conveyors 22 of the second set delivers pairs of spaced apart sections 7A of double unit length into successive flutes of the assembly conveyor 26 in such a way that each flute of the conveyor 26 contains two sections 6A and two sections 7A which alternate with the respective sections 6A. The four sections 6A,7A in each flute of the assembly conveyor 26 which advances beyond the conveyor 21 form a group 27. The sections of each group 27 advance between two stationary condensing cams (not shown) which cause the neighboring sections of each group to move into actual abutment with each other.

Successive groups 27 are accepted by a transfer conveyor 28 which is also a turn-around device in that it changes the orientation of each group by 90° and deposits successive groups 27 onto the adhesive-coated upper side of a web 31 consisting of cigarette paper, imitation cork or other suitable wrapping material. The web 31 is withdrawn from a roll 29 of convoluted wrapping material and travels above the upper reach of an endless conveyor belt 70 known as garniture.

The groups 27 which are deposited on the web 31 form a continuous filler 41 consisting of alternating sections 6A,7A and passing through a wrapping mechanism 44 which drapes the web around the filler to form a continuous filter rod 71 which is severed at regular intervals by a cutoff 48 to yield a single file of composite filter plugs 49 ready to be transported into a filter cigarette making machine, a filter cigar making machine, a filter cigarillo making machine or to storage.

The peripheral speed of the transfer conveyor 28 at least equals but preferably slightly exceeds the speed of the web 31 on the garniture 70. This insures that the sections 6A,7A of the filler 41 are disposed end-to-end without any clearances therebetween.

Figure 4:
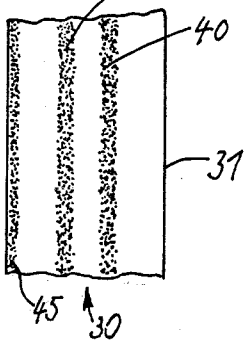
FIG. 4 is an enlarged fragmentary elevational view of a web with strips of adhesive applied thereto by the means shown in FIG. 1.

The web 31 is coated with adhesive upstream of the transfer conveyor 28. The adhesive applying means comprises a first paster 32 having a container 33 for storage of adhesive paste and two nozzles 34,36 connected to the outlet of the container 33 by conduit means 33*a*, and a second paster 37 having a container 38, a nozzle 39 and conduit means 38*a* connecting the outlet of the container 38 to the nozzle 39. The orifice of the nozzle 39 applies to one marginal portion of the running web 31 a strip 45 of adhesive, and the nozzles 34,36 apply two strips 35,40 of adhesive to intermediate portions of the web 11 (see FIG. 4). The stris 35,40 can be said to form a twin strip 30 which serves to prevent any shifting of sections 6A,7A once such sections come into contact with the adhesive-coated side of the web. The strip 45 serves to bond the respective marginal portion of the web 31 to the other marginal portion and to form therewith a seam which extends longitudinally of the filter rod 71. The paster 32 may comprise a single nozzle 34 or 36, or more than two nozzles, i.e., the strip 30 may constitute the strip 35 or 40 or it may consist of three or more strips.

The container 33 of the paster 32 stores a supply of cold or wet adhesive (e.g., a mixture of water and starch), and the container 38 of the paster 37 stores a supply of heat-activatable adhesive known as hotmelt. Therefore, the apparatus of FIG. 1 further comprises a first sealer 42 which heats the strips 35,40 to promote rapid setting of wet adhesive. The sealer or heating means 42 insures that the adhesive of the strips 35,40 sets as soon as or immediately after the respective portion of the web 31 is contacted by filter rod sections 6A,7A of the filler 41. Thus, the groups 27 are held against any axial and/or other movement relative to the web so that the sections 6A,7A of the entire filler 41 are disposed end-to-end during travel toward, through and beyond the wrapping mechanism 44. Shifting of groups 27 on the web 31 could be caused by next-following groups, by air currents and/or by friction during transport through the mechanism 44.

The sealer or heating means 42 further serves to activate the hotmelt of the strip 45 immediately upstream of the wrapping mechanism 44. Therefore, the material of the strip 45 forms a strong and reliable bond between the overlapping marginal portions of the tubular wrapper which is obtained by draping the web 31 around the filler 41. The seam including the overlapping marginal portions of the tubular wrapper is thereupon caused to pass along a second sealer 46 which constitutes or includes a means for cooling the strip 45 to thus insure rapid setting or hotmelt before the respective portion of the rod 71 reaches the cutoff 48. The cutoff 48 may be arranged to subdivide the rod 71 into filter plugs 49 of multiple unit length because it is easier to manipulate relatively long filter plugs during transport toward and in a machine for making filter cigarettes, cigars or cigarillos. For example, the cutoff 48 may subdivide the rod 71 into plugs 49 of the type shown in FIG. 5. Each plug 49 comprises a tubular wrapper 75, a centrally located section 6A and two sections 7AA each having a length equal to one-half of that of a section 7A. In the filter cigarette making machine, the plugs 49 are severed across the respective sections 6A (see the line X—X in FIG. 5) to yield pairs of filter plugs of unit length each including a section 7AA, one-half of a section 6A, and one-half of a wrapper 75. The severing of plugs 49 can take place subsequent to assembly of such plugs with pairs of plain cigarettes of unit length to form filter cirgarettes of double unit length. Once its plug 49 has been severed midway across the respective wrapper 75 and the section 6A, each cigarette of double unit length yields two filter cigarettes of unit length.

The placing of pasters 32,37 adjacent to each other is desirable and advantageous. Thus, a person inspecting the supply of adhesive in container 33 can also observe the contents of the container 38. The nozzles, 34,36,39 apply adhesive to the exposed side of the running web 31 in that portion of the elongated path for the web which precedes the path portion where the web receives successive groups 27 from the transfer conveyor 28. The web is advanced lengthwise by the garniture 70; in addition, the apparatus may comprise two driven advancing rollers 72 which draw the web off the roll 29.

As stated above, the paster 32 may comprise a single nozzle 34 or 36. The use of two or more nozzles is preferred at this time because each and every section 6A,7A is more likely to firmly adhere to the web 31 if the latter is provided with several strips of adhesive intermediate its marginal portions. The upper side of the web 31 between the guide roller 73 and the wrapping mechanism 44 may be slightly concave to further insure that each section 6A,7A will contact the strip 35 as well as the strip 40.

The apparatus of FIG. 1 can be modified by using the container 33 for storage of hotmelt and by maintaining a supply of wet adhesive in the container 38. The sealer 42 then includes or constitutes a cooling device which causes the material of the strips 35,40 to set as soon as the respective portion of the web 31 comes into contact with sections 6A,7A, and the sealer 46 then includes or constitutes a device which heats the cam of the wrapper to promote setting of the wet adhesive forming the strip 45. In the just described apparatus, the container 33, the conduit means **33*a* and/or the nozzles 34,36 comprise means for heating and for thus activating the hotmelt. Alternatively, the strips 3,40 can be heated and their material activated in the region between the nozzle 36 and transfer conveyor 28.**

The manner in which the conveyor 28 transfers groups 27 from the assembly conveyor 26 onto the web 31 is disclosed in the commonly owned copending application Ser. No. 622,333 filed Oct. 14, 1975 by District Bordenhogen et al.

Figure 2:
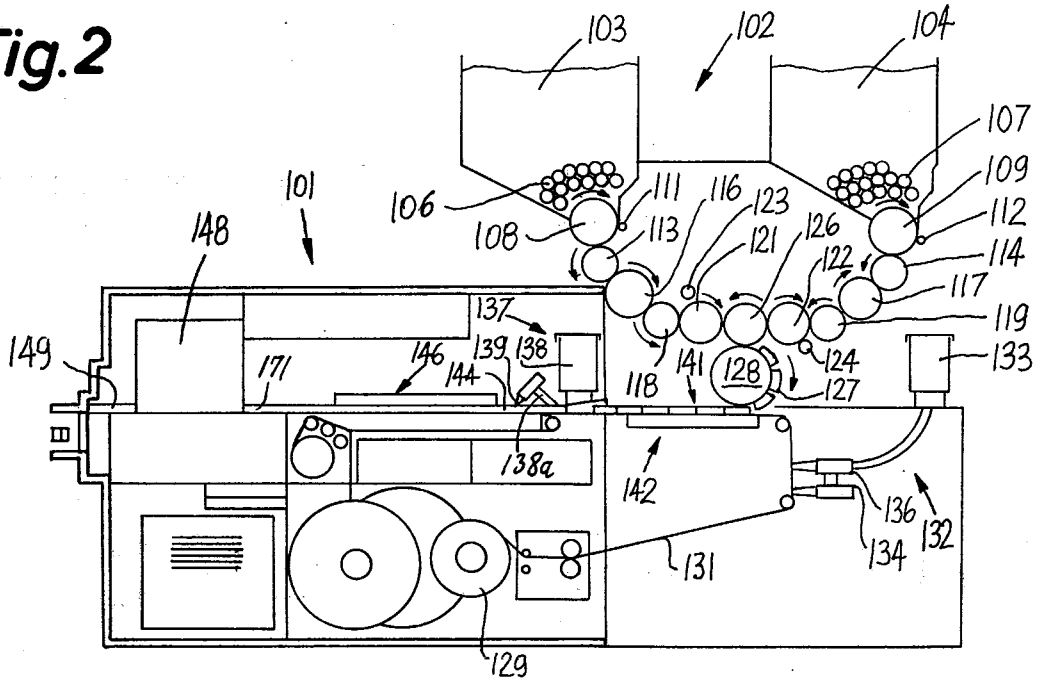
FIG. 2 is a similar view of a filter plug making apparatus having modified applying means.

FIG. 2 shows an apparatus 101 having adhesive applying means which constitute a first modification of the adhesive applying means of FIG. 1. All such parts of the apparatus 101 of FIG. 2 which are identical with or clearly analagous to the corresponding parts of the apparatus 1 are denoted by similar reference characters plus 100.

The first paster 132 is mounted in the same way as the paster 32 of FIG. 1, i.e., its nozzles 134,136 apply strips 35,40 to an intermediate portion of the web 131 upstream of the transfer conveyor 128, and the wet adhesive supplied by the orifices of the nozzles 134,136 is heated by the sealer 142.

The second paster 137 is mounted downstream of the transfer conveyor 128 and has a nozzle 139 whose orifice discharges heated (activated) hotmelt against one marginal portion of the web 131. The hotmelt is caused to set during travel along the sealer 146 which constitutes or includes a cooling device. The hotmelt need not be heated in the container 138, conduit **138*a* and/or nozzle 139 if the wrapping mechanism 144 comprises means for heating the adhesive strip which is applied by the orifice of the nozzle 139.**

If the container 133 stores a supply of hotmelt, the sealer 142 comprises or constitutes a cooling device. The container 138 comprises or constitutes a heating device. If the containers 133 and 138 store supplies of a wet adhesive, each of the sealers 142,146 comprises or constitutes a heating devices. If the containers 133 and 138 store supplies of hotmelt, each of the sealers 142,146 comprises or constitutes a cooling device.

Figure 3:
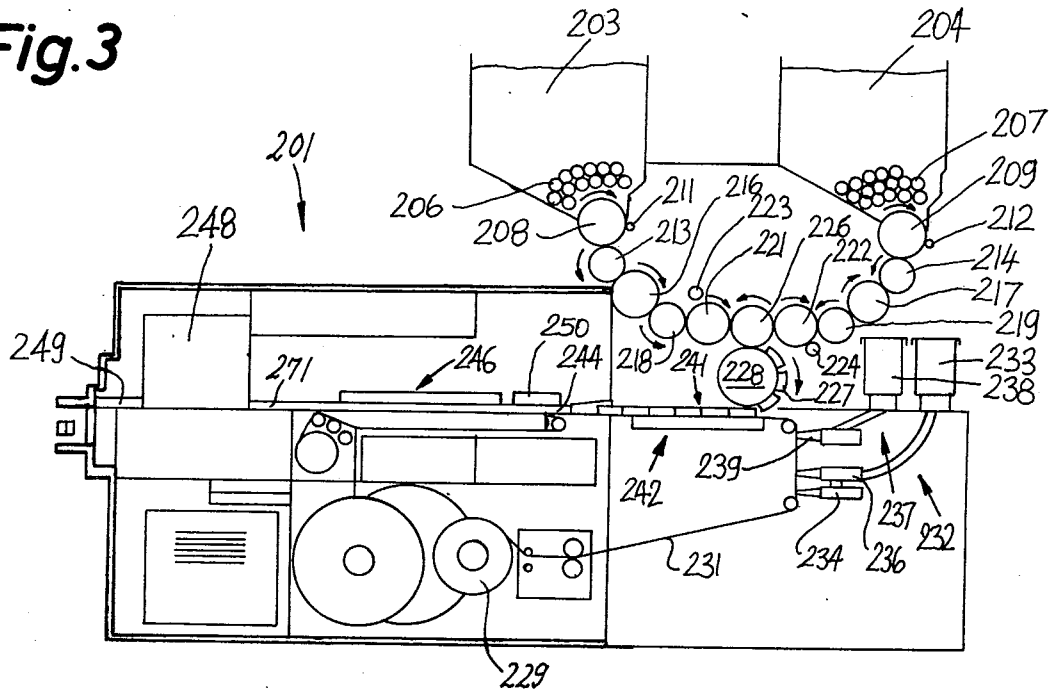
FIG. 3 is a similar view of a filter plug making apparatus having third adhesive applying means.

FIG. 3 shows a third apparatus 201 wherein the adhesive applying means constitutes a further modification of the adhesive applying means of FIG. 1. All such parts of the apparatus 201 which are identical with or clearly analagous to corresponding parts of the apparatus 1 are denoted by similar reference characters plus 200. Each of the containers 233,238 stores a supply of hotmelt. The orifices of the nozzles 234,236,239 respectively apply the strips 35,40,45 and the sealer 242 constitutes or comprises a cooling device for the material of the strips 35,40. A heater 250 is provided in the region of the wrapping mechanism 244 to heat and thereby activate the material of the strip 45, and such material is cooled by the sealer 246 as soon as it issues from the mechanism 244 so that the seam of the tubular wrapper of the rod 271 is strong enough to remain unaffected by the severing action of the knife or knives of the cutoff 248. The heater 250 insures that the material of the strip 45 (which might have been deactivated during travel past the cooling device of the sealer 242) is activated by heat not later than when the respective marginal portion is folded over the other marginal portion of the web 231.

Figure 5:
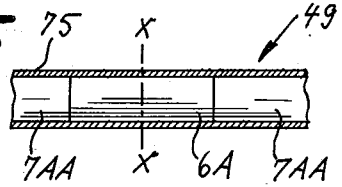
FIG. 5 is a sectional view of a composite filter plug.

The improved apparatus exhibit the advantage that the groups 27,127 or 227 and their sections are held against any movement with respect to each other during travel toward, through and beyond the wrapping mechanism. This is especially important when the speed of the conveyor 28,128 or 228 exceeds the speed of the web, i.e., when a freshly transferred group 27,127 or 227 exhibits the tendency to move the preceding group longitudinally of the web. Consequently, the apparatus can turn out filter plugs 49,149 or 249 which are identical in each and every repect. As shown in FIG. 5 by the line X—X, the cutoff can be designed to sever the rod 71,171 or 271 midway across each second section of double unit length. It is immaterial whether the knife or knives of the cutoff sever the sections 6A or 7A except, of course, if it is desired that a particular section be adjacent to the tobacco filler of a filter cigarette, cigar or cigarillo.

Without further analysis, the foregoing will so fully reveal the gist of the present invention that others can, by applying current knowledge, readily adapt it for various applications without omitting features which fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forh in the appended claims.

1. In an apparatus for making composite filter plugs wherein a tubular wrapper surrounds several types of filter material, a combination comprising means for advancing a continuous web of wrapping material lengthwise along a predetermined path wherein one side of the web remains exposed; a first paster having means for applying adhesive to an intermediate portion of said one side of the web in a first portion of said path; means for transferring filter rod sections of several types onto said one side of the web in second portion of said path so that the sections abut against each other end-to-end and adhere to said intermediate portion of said one side of the web to form an elongated filler; first sealer means for promoting the setting of adhesive in the region of said second portion of said path so as to reduce the likelihood of shifting of the abutting sections of said filler relative to said web; a second paster having means for applying adhesive to one marginal portion of the web; means for draping the web around said filler so that said one marginal portion contacts and is bonded to the other marginal portion of the web whereby the thus draped web constitutes the tubular wrapper of the resulting filter rod; second sealer means for promoting the setting of adhesive which bonds said marginal portions; and means for subdividing said rod into discrete filter plugs each of which contains at least a portion of a section of each of said several types.

2. A combination as defined in claim 1, wherein one of said pasters comprises a supply of adhesive which sets in response to heating and the respective sealer means comprises means for heating the adhesive which is applied by said one paster, the other of said pasters comprising a supply of adhesive which sets in reponse to cooling and the respective sealer means comprising means for cooling the adhesive which is applied by said other paster.

3. A combination as defined in claim 2, wherein said one paster is said first paster.

4. A combination as defined in claim 2, wherein said one paster is said second paster.

5. A combination as defined in claim 1, wherein said second paster is located upstream of said second portion of said path.

6. A combination as defined in claim 1, wherein said second paster is located downstream of said second portion of said path.

7. A combination as defined in claim 1, wherein said second paster is located upstream of said second portion of said path and each of said pasters comprises a supply of adhesive which is activated by heating and sets in response to cooling, each of said sealer means comprising a device for cooling the adhesive applied by the respective paster and further comprising means for heating the adhesive applied by said second paster intermediate said first sealer means and said draping means.

8. A combination as defined in claim 1, wherein each of said pasters comprises a supply of wet adhesive which sets in response to heating and each of said sealer means comprises means for heating the adhesive which is applied by the respective paster.

9. A combination as defined in claim 1, wherein said first paster comprises several adhesive applying nozzles.

10. A combination as defined in claim 9, wherein said second paster comprises a single adhesive applying nozzle.

11. A combination as defined in claim 1, further comprising means for supplying to said transferring means groups of aligned filter rod sections of at least two different types.

* * * * *

UNITED STATES PATENT OFFICE
CERTIFICATE OF CORRECTION

Patent No. 4,020,751 Dated May 3, 1977

Inventor(s) Heinz Greve and Peter Grumer

It is certified that error appears in the above-identified patent and that said Letters Patent are hereby corrected as shown below:

Foremost page, left-hand column, item [73], "Hauni-Werke Korber & Co., KG," should read --Hauni-Werke Körber & Co. KG,--.

Col. 1, line 20, "a" (third occurrence) should read --of--;
line 33, "operation" should read --operations--.

Col. 2, line 14, "of" should read --or--;
line 42, "of" (first occurrence) should read --or--;
line 46, --a-- should be inserted before "wet";
line 52, --for heating-- should be inserted after "device";
line 68, --adhesive-- should be inserted after "modified".

Col. 3, line 21, "of" should read --the--.

Col. 4, line 46, "stris" should read --strips--.

Col. 5, line 68, "cam" should read --seam--.

Col. 6, line 12, "District" should read --Dietrich--;
line 38, --then stores a supply of wet adhesive and the sealer 146-- should be inserted after "138";
line 41, "devices." should read --device.--.

Col. 7, line 37, --a-- should be inserted after "in".

Signed and Sealed this

*Eighth* Day of *November 1977*

[SEAL]

*Attest:*

RUTH C. MASON
*Attesting Officer*

LUTRELLE F. PARKER
*Acting Commissioner of Patents and Trademarks*